United States Patent [19]

Starkey

[11] Patent Number: 4,475,427

[45] Date of Patent: Oct. 9, 1984

[54] FREQUENCY INDEPENDENT RAMP GENERATOR

[75] Inventor: David T. Starkey, Billerica, Mass.

[73] Assignee: Norlin Industries, Inc., White Plains, N.Y.

[21] Appl. No.: 291,158

[22] Filed: Aug. 10, 1981

[51] Int. Cl.[3] ..... G10H 1/00

[52] U.S. Cl. ..... 84/1.01; 328/35; 307/228; 307/261; 331/145

[58] Field of Search ..... 328/35; 307/228, 261; 331/143, 145; 84/1.01, DIG. 26

[56] References Cited

U.S. PATENT DOCUMENTS 4,016,496 4/1977 Eastcott ..... 328/35

OTHER PUBLICATIONS

Jung, IC OP-AMP Cookbook, p. 79 (1974).

*Primary Examiner*—Forester W. Isen

*Attorney, Agent, or Firm*—Ronald J. Kransdorf

[57] ABSTRACT

A tone generator for an electronic musical instrument is operable for producing a highly stable tone signal over an extended frequency range. The tone generator comprises a timing circuit defining first and second time intervals occurring in respective time succession after the occurrence of a transition of an input signal. A timing capacitor is charged during each second time interval and discharged during the time intervals occurring between the end and beginning of successive ones of the second time intervals. A feedback circuit is enabled during each of the first time intervals for coupling the timing capacitor for controlling the discharge rate so that a highly stable ramp output tone signal is produced.

6 Claims, 2 Drawing Figures

FREQUENCY INDEPENDENT RAMP GENERATOR

BACKGROUND OF THE INVENTION

The present invention relates generally to electronic musical instruments and, more particularly, to an improved tone generator for a keyboard electronic musical instrument which is capable of producing ramp and pulse width waveform tone signals whose amplitudes and pulse widths are extremely stable over a relatively wide frequency range.

Tone generators are typically used in keyboard electronic musical instruments for producing tone signals having waveforms adapted for simulating the sounds of selected acoustical musical instruments. For example, a tone signal having a ramp waveform is normally used to simulate the sound produced by a piano while the sounds of a jazz guitar and a jazz flute are usually simulated by fixed pulse width and square-wave waveform tone signals respectively.

In the past, the tone generation function of keyboard electronic musical instruments has been implemented by a plurality of tone signal waveform generating circuits, each such circuit being dedicated to a single keyboard key and having components tailored to the corresponding specific frequency. More recently, time-shared tone generation systems have found widespread use in keyboard electronic musical instruments, such use being largely facilitated by the incorporation of microprocessor systems in the instruments. In a time-shared tone generation system a limited number of individual tone generators are provided, each tone generator comprising a multifrequency tone signal source operable in response to a plurality of keyboard keys. As a result, it is desirable that each of the tone generators be operable over a relatively wide frequency range without distorting the characteristics, e.g. amplitude, waveshape, etc., of the tone signal produced thereby. Prior art tone generators used in time-shared tone generation systems normally comprise relatively complex digital circuits which are not considered to be sufficiently stable over the extended frequency range involved for producing tone signals to a desired degree of accuracy.

It is therefore a basic object of the present invention to provide an improved tone generator for use in a keyboard electronic musical instrument embodying a time-shared tone generation system.

It is a more specific object of the invention to provide a tone generator of the foregoing type which is relatively noncomplex in construction and which is capable of producing tone signals whose waveform characteristics are extremely stable over a wide frequency range.

SUMMARY OF THE INVENTION

In accordance with these and other useful objects of the tone generator of the present invention comprises a timing circuit defining first and second relatively short time intervals occurring in respective time succession substantially immediately after each occurrence of a logical transition of a periodic input signal. A timing capacitor is charged to a predetermined voltage through a switch which is enabled during each of the second time intervals and is subsequently discharged through the emitter-collector circuit of a transistor during the time intervals between the end and beginning of successive ones of the second time intervals. A feedback circuit is enabled during each of the first time intervals for sampling the voltage developed across the timing capacitor so as to supply a substantially constant base current to the discharge transistor whereby a constant discharge current is achieved resulting in the timing capacitor exhibiting a constant discharge rate for forming a stable output ramp tone signal.

BRIEF DESCRIPTION OF THE DRAWINGS

The features of this invention which are believed to be novel are set forth with particularity in the appended claims. The invention, together with its objects and the advantages thereof, may best be understood by reference to the following description taken in conjunction with the accompanying drawings in which:

DESCRIPTION OF THE PREFERRED EMBODIMENT

Figure 1:
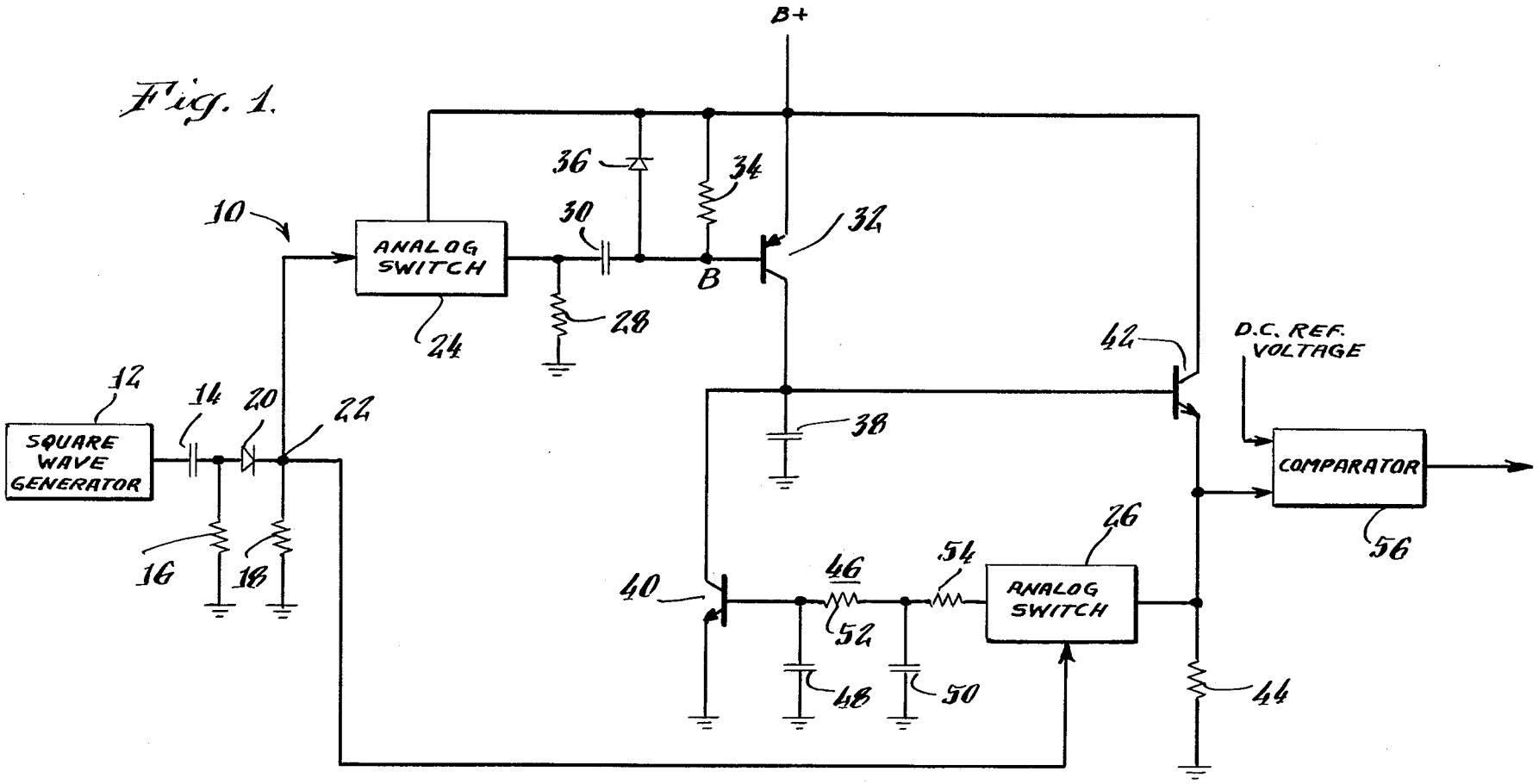
FIG. 1 is an electrical schematic diagram, partly in block form, showing a preferred embodiment of the tone generator of the present invention.
Figure 2:
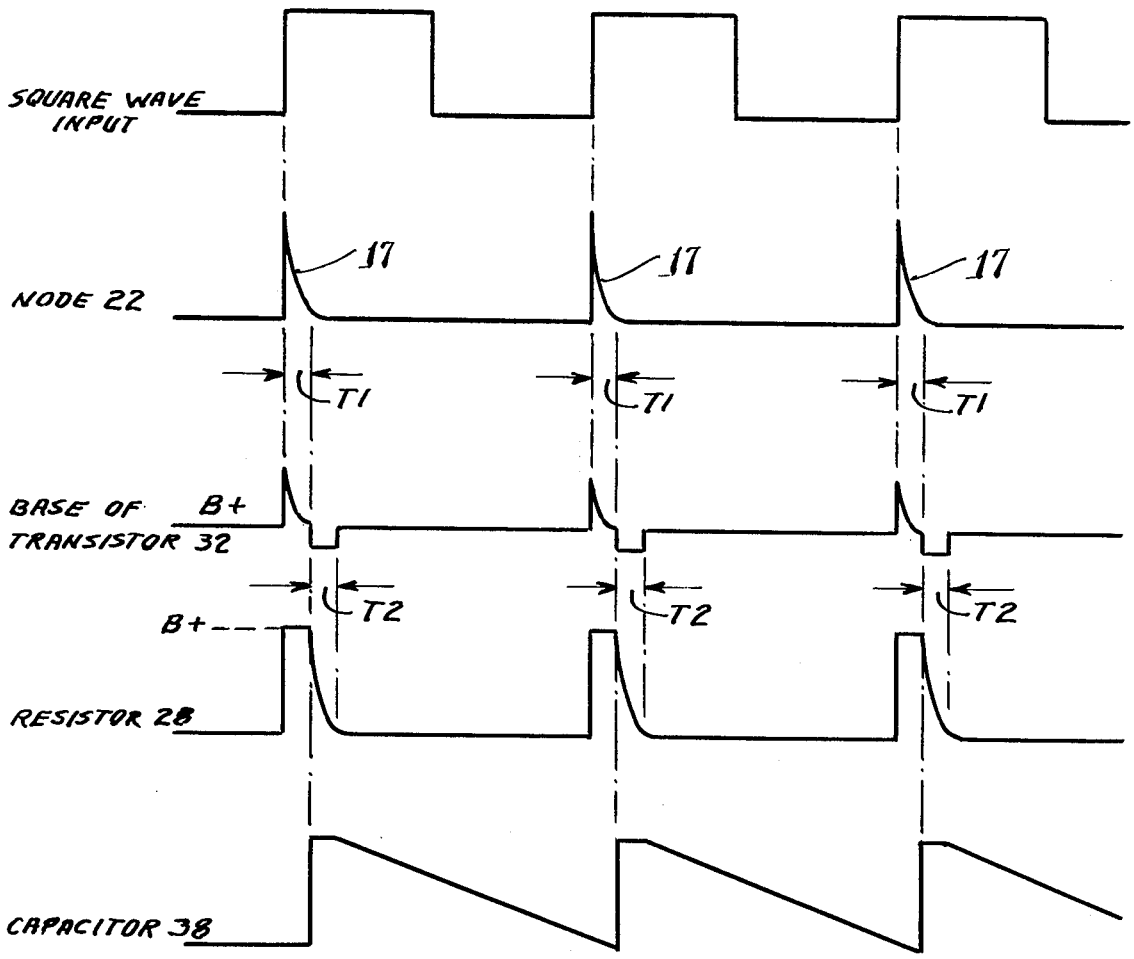
FIG. 2 graphically illustrates various signal waveforms pertinent to an explanation of the operation of the tone generator of FIG. 1.

Referring now to the drawings and, in particular, to FIG. 1, the tone generator of the present invention is generally identified by reference numeral 10. The output of a square-wave generator 12, or any other signal source providing an output signal having periodic positive-going transitions, is operated at a selected frequency corresponding to the desired tone signal output frequency. The output square-wave signal is supplied to tone generator 10 through an input differentiating network comprising a capacitor 14, a pair of grounded resistors 16 and 18 and a diode 20, the cathode of diode 20 being connected to the ungrounded terminal of resistor 18 at a node 22 and the common junction formed between resistor 16 and capacitor 14 being connected to the anode of diode 20. The square-wave input signal supplied by generator 12 is represented by the first waveform of FIG. 2 while the positive-going differential signal spikes 17 produced at node 22 in time coincidence with the leading edges of the input square-wave signal are illustrated by the second waveform of FIG. 2. Diode 20 serves to block or inhibit the development of corresponding negative-going signal spikes in response to the trailing edges of the input square-wave signal.

The differentiated signal spikes 17 produced at node 22 are coupled for gating a pair of analog switches 24 and 26. Analog switch 24 is connected between a source of positive supply potential B+ and a grounded resistor 28, resistor 28 also being connected through a capacitor 30 to the base of a PNP transistor 32. The base of transistor 32 is connected to positive supply potential B+ through the parallel combination of a resistor 34 and a diode 36. The emitter of transistor 32 is also connected to positive supply potential B+ while the transistor's collector is connected to ground through a timing capacitor 38. Prior to each time interval T1 defined by a signal spike 17, the voltage at the base of transistor 32 and the plate of capacitor 30 connected thereto is equal to positive supply potential B+ while the voltage at the other plate of capacitor 30 is at ground potential. As a consequence, transistor 32 is non-conductive and no charging current is supplied to timing capacitor 38. Upon the occurrence of a signal spike 17, analog switch 24 is rendered conductive during time interval T1 whereby the previously grounded plate of capacitor 30 is immediately brought to supply potential B+ causing the voltage at the plate of capacitor 30 connected to the base of transistor 32 to rise by a corresponding amount. Thereafter, and before the end of time interval T1, capacitor 30 rapidly discharges through diode 36 until the voltage at both of its plates are equal to supply potential B+.

Analog switch 24 is subsequently rendered non-conductive after the occurrence of the signal spike 17 or, more specifically, after the amplitude of signal spike 17 has been reduced to below the gating threhshold of the analog switch. At this time, the plate of capacitor 30 connected to resistor 28 is pulled down to ground potential thereby reducing the voltage at the base of transistor 32 from supply potential B+ and rendering transistor 32 conductive. Transistor 32 remains conductive for a second time interval T2 unitl its base is re-established at supply potential B+ thereby charging timing capacitor 38 to supply potential B+.

The ungrounded plate of timing capacitor 38 is connected to the collector of a discharging transistor 40 and to the base of an output transistor 42. The emitter of output transistor 42, which follows the voltage developed across timing capacitor 38, is connected to ground by a resistor 44 and through analog switch 26 to a capacitive network 46 connected to the base of discharging transistor 40. Capacitive network 46 comprises a pair of capacitors 48, 50 and a pair of resistors 52, 54 connected as shown.

Following the time intervals T2 during which charging transistor 32 is conductive, timing capacitor 38 is discharged through the emitter-collector circuit of discharge transistor 40 at a relatively constant rate. That is, as will be explained further below, the discharge current flowing in the emitter-collector circuit of transistor 40 is maintained substantially constant so that the voltage across timing capacitor 38 decreases at a relatively constant rate synthesizing a linearly decaying ramp signal. The emitter of transistor 42 follows the ramp voltage developed across timing capacitor 38 thereby producing an extremely stable output ramp waveform signal.

The ramp waveform tone signal produced at the emitter of transistor 42 is fed back by analog switch 26 to capacitive network 46 during the time intervals T1 defined by signal spikes 17. Depending on the amplitude of the ramp waveform tone signal during these time intervals, the charge stored by capacitive network 46 is adjusted for supplying a level of base current for increasing or decreasing the conduction of discharge transistor 40 for causing the ramp waveform tone signal to assume an amplitude near zero volts following each signal spike 17. More specifically, when square-wave generator 12 is initially tuned for producing an input signal at a selected repetition rate, the base current of discharge transistor 40 is adjusted over several alternations of the output ramp tone signal until a desired discharge rate of timing capacitor 38 is achieved. At this time, capacitive network 46 will reach an equilibrium point wherein the sampled output ramp tone signal supplies just enough charge thereto to maintain a constant base current for discharging transistor 40. As a consequence, the discharge current flowing in the emitter-collector circuit of transistor 40 is maintained at a constant level causing timing capacitor 38 to discharge at a constant rate thereby producing a highly stable output ramp tone signal at the emitter of transistor 42.

In summary, during each time interval T2 defined by the conducting state of transistor 32, timing capacitor 38 is charged to supply potential B+. Thereafter, timing capacitor 38 discharges at a constant rate through the emitter-collector circuit of transistor 40. Just prior to each of the foregoing charging intervals, the output ramp tone signal (which follows the discharge rate of timing capacitor 38) is sampled during a time interval T1 defined by a signal spike 17 producing a feedback signal for adjusting or maintaining the conduction of transistor 40 at a level for achieving the desired output ramp tone signal.

The output ramp tone signal may be converted to a pulsating signal by a comparator 56. The output of comparator 56 may, for example, go high whenever the ramp tone signal exceeds a predetermined DC reference voltage and otherwise assume a low level. In this manner, the tone generator 10 may be used to produce a highly stable output pulse waveform tone signal.

While a particular embodiment of the invention has been shown and described, it will be obvious to those skilled in the art that changes and modifications may be made without departing from the invention in its broader aspects. Therefore, the aim in the appended claims is to cover all such changes and modifications as fall within the true spirit and scope of the invention.

What is claimed is:

1. A tone generator for producing a tone signal having a periodic ramp waveform in an electronic musical instrument comprising:

means producing an input signal having periodic transistions of a selected polarity;

a charge storage device;

means responsive to said input signal for developing a control signal having a waveform including first and second portions respectively representing first and second relatively short time intervals relative to the period of said ramp waveform occurring in respective time succession only substantially immediately after each occurrence of one of said transitions of said input signal;

means charging said charge storage device to a predetermined voltage during each of said second time intervals;

a transistor having an emitter-collector circuit connected between said storage device and ground potential for discharging said storage device during the time intervals occurring between the end and beginning of successive ones of said second time intervals; and feedback means comprising a capacitive network connected to the base terminal of said transistor and switching means enabled during each of said first time intervals for coupling an amount of charge from said storage device to said capacitive network so as to provide a substantially constant current at the base terminal of said transistor, whereby the current in said emitter-collector circuit is substantially constant for discharging said storage device at a substantially constant rate.

2. The tone generator according to claim 1 wherein said input signal producing means comprises means producing an input square-wave signal and wherein said selected polarity transitions comprise the positive-going edges of said input square-wave signal.

3. The tone generator according to claim 1 wherein said charge storage device comprises a timing capacitor and wherein said charging means comprises a source of potential having a DC voltage equal to said predetermined voltage and second switching means enabled during each of said second time intervals for charging said timing capacitor from said source of potential.

4. The tone generator according to claim 1 including an output voltage following transistor connected between said storage device and said switching means.

5. A tone generator for producing a tone signal having a periodic ramp waveform in an electronic musical instrument comprising:

means producing an input signal having periodic transitions of a selected polarity;

a timing capacitor;

means responsive to said input signal for developing a control signal having a waveform including first and second portions respectively representing a first relatively short time interval relative to the period of said ramp waveform occurring only substantially immediately after each of said transitions of said input signal and a second relatively short time interval relative to the period of said ramp waveform occurring only substantially immediately after the occurrence of each of said first time intervals;

a source of reference voltage;

means enabled during each of said second time intervals for charging said timing capacitor to said reference voltage;

a transistor having an emitter-collector circuit connected between said timing capacitor and ground potential for discharging said timing capacitor at a substantially constant rate during the time intervals occurring between the end and beginning of successive ones of said second time intervals; and feedback means comprising a capacitive network connected to the base terminal of said transistor and switching means enabled during each of said first time intervals for coupling an amount of charge from said timing capacitor to said capacitive network so as to provide a substantially constant current at the base terminal of said transistor, whereby the current in the emitter-collector circuit is substantially constant for discharging said timing capacitor at a constant rate.

6. The tone generator according to claim 5 wherein said input signal producing means comprises means producing an input square-wave signal and wherein said selected polarity transitions comprise the positive-going edges of said input square-wave signal.

* * * * *